US006675774B2

(12) United States Patent
Frank et al.

(10) Patent No.: US 6,675,774 B2
(45) Date of Patent: Jan. 13, 2004

(54) FUEL INJECTION SYSTEM FOR INTERNAL COMBUSTION ENGINES, IN PARTICULAR DIESEL ENGINES

(75) Inventors: Kurt Frank, Schorndorf (DE); Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 36 days.

(21) Appl. No.: 10/147,075

(22) Filed: May 17, 2002

(65) Prior Publication Data

US 2002/0179056 A1 Dec. 5, 2002

(30) Foreign Application Priority Data

May 29, 2001 (DE) ..... 101 25 944

(51) Int. Cl.[7] ..... F02M 55/02
(52) U.S. Cl. ..... 123/456; 123/457
(58) Field of Search ..... 123/457, 467, 123/456, 468–469

(56) References Cited

U.S. PATENT DOCUMENTS 4,205,637 A * 6/1980 Ito et al. ..... 123/514
4,653,528 A * 3/1987 Field et al. ..... 123/511
4,732,131 A * 3/1988 Hensel ..... 123/514
6,135,092 A * 10/2000 Schaenzer ..... 123/456
6,148,798 A * 11/2000 Braun et al. ..... 123/467
6,311,673 B1 * 11/2001 Hotta et al. ..... 123/456
6,336,442 B1 * 1/2002 Kilgore ..... 123/456

* cited by examiner

*Primary Examiner*—Thomas N. Moulis
(74) *Attorney, Agent, or Firm*—Ronald E. Greigg

(57) ABSTRACT

A fuel injection system for internal combustion engines, in particular Diesel engines, having a fuel reservoir which is supplied from a high-pressure pump and supplies fuel to a number of injectors corresponding to the number of cylinders of the engine, and has a pressure limiting valve, which is connected sealingly to the fuel reservoir, the pressure limiting valve having a valve housing, a high-pressure region, a low-pressure region, a valve seat oriented toward the inlet, an axially displaceable valve body, and a valve spring urging the valve body in the direction of the valve seat. The pressure limiting valve is integrated—at least partially—with the fuel reservoir, in such a way that at least the valve seat and the valve body are spatially associated with the fuel reservoir, and the seal sealing off the pressure limiting valve from the fuel reservoir is associated with the low-pressure region of the pressure limiting valve.

21 Claims, 3 Drawing Sheets

FUEL INJECTION SYSTEM FOR INTERNAL COMBUSTION ENGINES, IN PARTICULAR DIESEL ENGINES

BACKGROUND OF THE INVENTION

1. Field of the Invention

The invention relates to a fuel injection system of the type employing a common rail and a pressure limiting valve for lowering system pressure 2. Description of the Prior Art Fuel reservoir injection systems (so-called common rail systems) are known in principle. A distinction is made between common rail systems with a quantity-regulated high-pressure pump (known as CP3 systems), in which a pressure reduction in the fuel pressure reservoir (rail) is possible only via the injection and control quantity and leakage, and common rail systems in which a pressure limiting valve on the high-pressure side is used to lower the system pressure. The subject of the present invention is the latter type of system, that is, one with a pressure limiting valve for lowering the system pressure.

With respect to the prior art for such pressure limiting valves, reference may be made for instance to European Patent Disclosure EP 0 267 162 B1 and German Patent Disclosure DE 198 22 671 A1. The known pressure limiting valves are intended exclusively for mounting not only outside the fuel injection pump (the high-pressure pump) but also outside the fuel reservoir (rail) per se. Typically, the pressure limiting valve is secured to the end of the fuel reservoir remote from the high-pressure pump. Because of the high pressure prevailing in the fuel reservoir, until now a valve housing with a threaded stub for screwing the pressure limiting valve to the fuel reservoir was practically indispensable. Because of the high pressure, problems arise in particular in sealing off the pressure limiting valve from the fuel reservoir. Other inadequacies of the known system result from the requirement that on account of the high pressure, the valve housing must be very massive (high costs!) and because of the comparatively large installation space required.

OBJECT AND SUMMARY OF THE INVENTION

The object of the invention is to make suitable provisions for eliminating or at least significantly reducing the problems of sealing, components and installation space, at reasonable engineering effort and expense.

By means of the integration, according to the invention, of the valve seat and the valve body and thus of the essential functional elements of the pressure limiting valve with the fuel reservoir, the region where the pressure limiting valve is sealed off is shifted from the (former) high-pressure region to the low-pressure region, which makes the sealing task considerably easier to perform. At the same time, this provision of the invention advantageously provides a corresponding reduction in the installation space required and also affords the possibility of designing the pressure limiting valve housing, and its fastening to the fuel reservoir, in a less complicated way than before.

BRIEF DESCRIPTION OF THE DRAWINGS

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
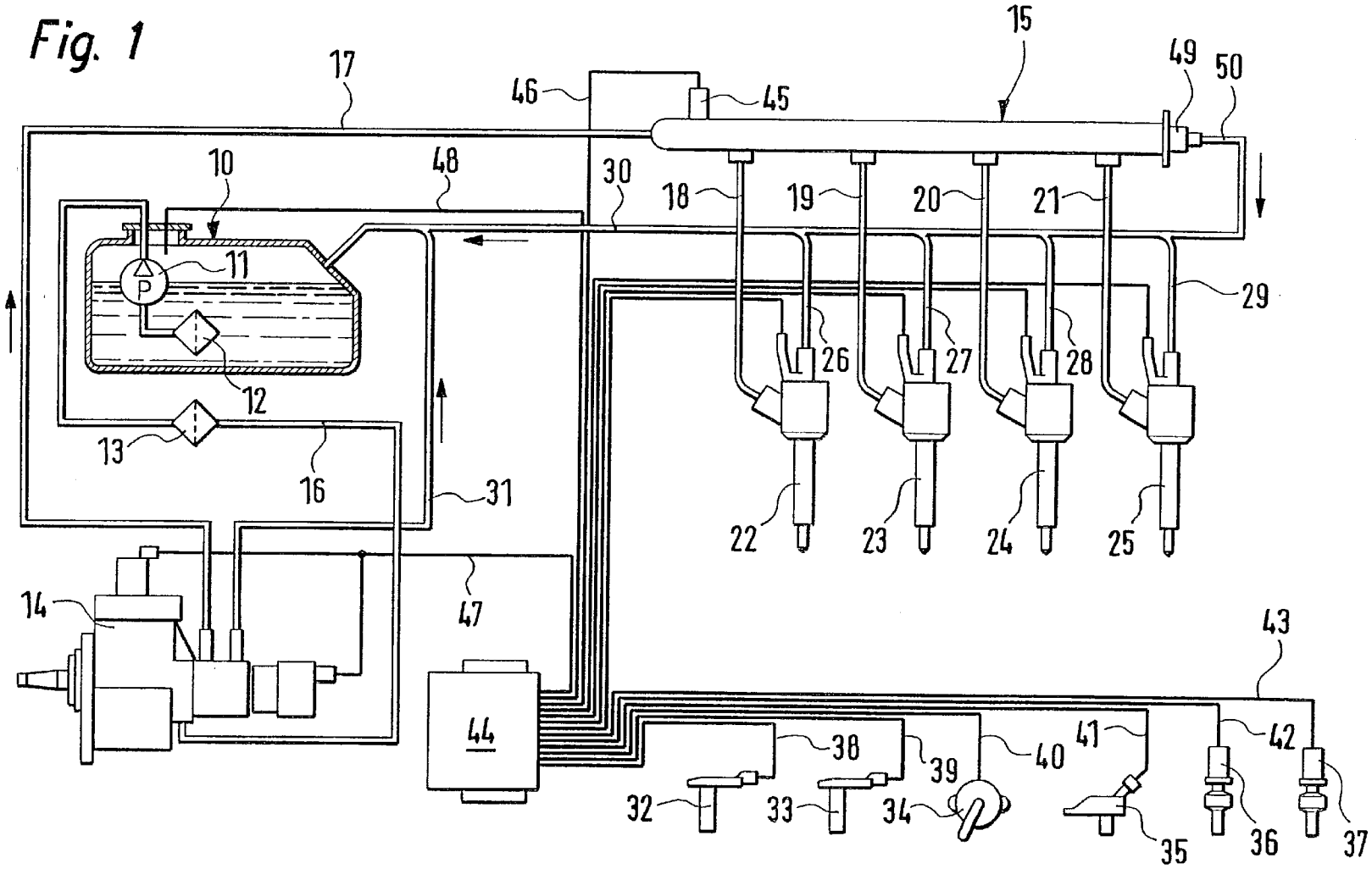
FIG. 1, in the form of a block circuit diagram, shows one embodiment of a fuel injection system of the type in question.

In FIG. 1, reference numeral 10 overall designates a fuel tank, with an electric fuel pump 11, prefilter 12, and filter 13. A high-pressure pump is identified by reference numeral 14, and a fuel reservoir (or so-called common rail) is identified overall by reference numeral 15. From the fuel tank 10, the fuel is pumped by the fuel pump 11 via a low-pressure line 16 to the high-pressure pump 14, which brings the fuel to high pressure and delivers it to the fuel reservoir 15 via a high-pressure line 17. The fuel reservoir 15 supplies four injectors 22–25 of a four-cylinder internal combustion engine (not shown)—each via a respective high-pressure line 18, 19, 20 and 21—with the fuel they require. Fuel that is (perhaps) not required by the injectors 22–25 reaches a return collection line 30 via a respective return line 26, 27, 28 and 29, and from the line 30 it is returned to the tank 10. A certain (slight) leakage quantity also returns to the fuel tank 10 from the high-pressure pump 14, via a return line 31 and the return collection line 30.

For ascertaining the quantity of fuel required by the injectors 22–25 in a given operating state of the engine, six sensors in all are provided, identified by reference numerals 32–37. The sensor 32 is associated with the crankshaft and accordingly monitors the applicable engine rpm. The sensor 33, associated with the camshaft, serves to monitor the phase of the engine at a given time. The sensor 34 is associated with the accelerator pedal and accordingly takes the acceleration desired by the driver at a given time into account. The sensor 35 takes the engine charge pressure into account, while sensor 36 detects the air temperature and sensor 37 detects the coolant temperature. Corresponding signals from the sensors 32–37 travel over signal lines 38–43 to reach a control unit 44, which processes the signals. A further sensor 45 ascertains the applicable pressure in the fuel reservoir 15 and—via a signal line 46—sends signals accordingly to the control unit 44. Taking the incoming signals into account, the control unit 44 triggers both the high-pressure pump 14 and the fuel pump 11 via respective control lines 47 and 48.

On the end of the fuel reservoir 15 remote from the high-pressure inlet 17, there is a pressure limiting valve 49—shown only schematically in FIG. 1—which has the task of preventing the pressure in the fuel reservoir 15 from exceeding a fixed maximum value. The fuel quantity that is—optionally—diverted from the fuel reservoir 15 for this purpose in the opening position of the pressure limiting valve 49 returns to the fuel tank 10, via a return line 50 that discharges into the return collection line 30.

Figure 2:
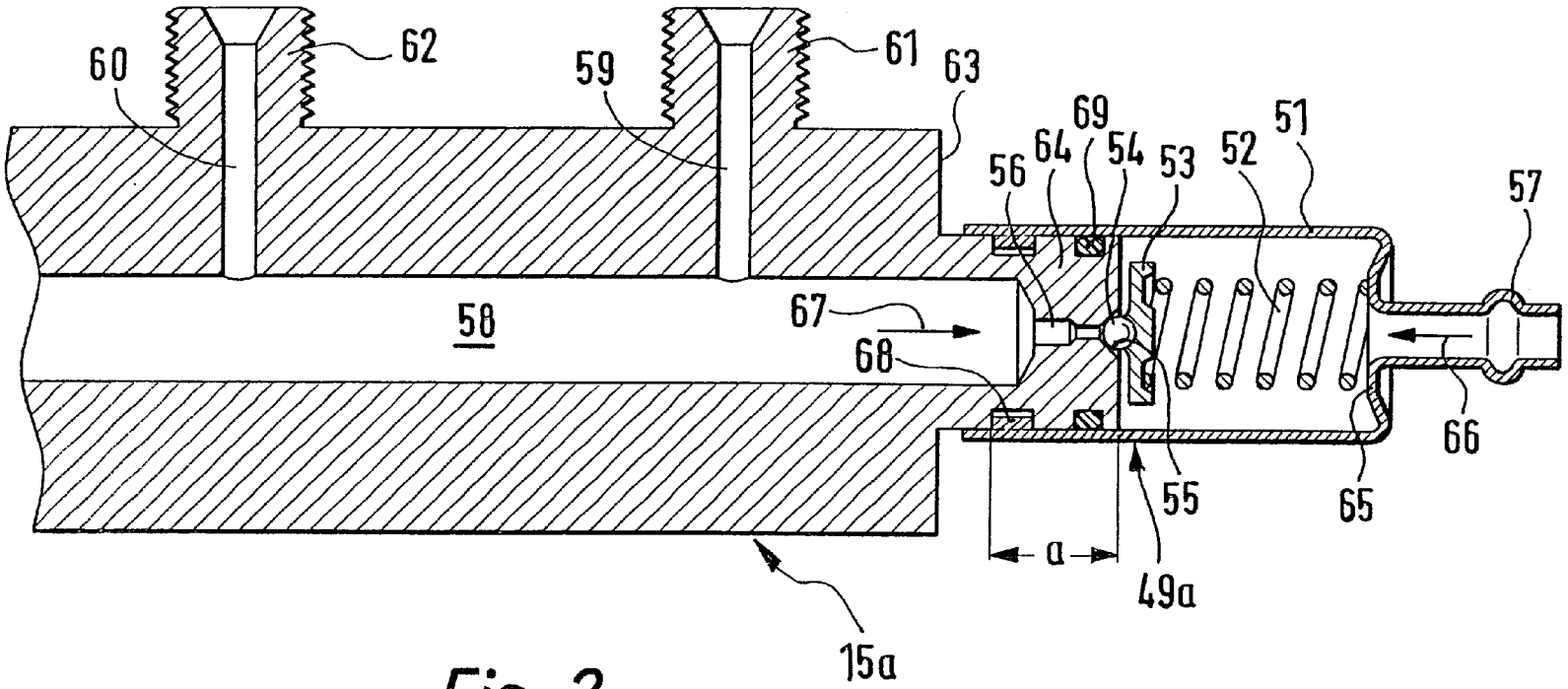
FIG. 2, in vertical longitudinal section, shows one embodiment of a pressure limiting valve.

One possible embodiment of a pressure limiting valve can be seen in FIG. 2, where it is identified overall by reference numeral 49*a*. It comprises a valve housing 51, a valve spring 52, a platelike spring support 53, a ball-shaped valve body 54, a conical valve seat 55, an inlet bore 56 that tapers in stages in the direction toward the valve seat 55 and discharges into the valve seat, and a return connector 57 formed integrally onto the back end of the valve housing 51.

One special feature is that the pressure limiting valve 49*a* is integrated partially, specifically in terms of its essential parts, that is, the valve seat 55 and the inlet bore 56, with the fuel reservoir (shown only in part in FIG. 2) identified overall by reference numeral 15*a*. The fuel reservoir—in the usual way—has a cylindrical inner chamber 58, from which fuel conduits 59, 60 extend at a right angle, discharging into line connectors 61 and 62, respectively. To the line connectors 61, 62 (and to corresponding further line connectors not shown in FIG. 2), pressure lines (not shown) can be connected, which—as can be seen from FIG. 1, for example—lead to injectors (marked 22-25 in FIG. 1).

A (further) special feature is that the fuel reservoir 15*a*—on its end face 63 toward the valve and graduated relative to this end face—has a connector neck 64, which is disposed concentrically to the cylindrical inner chamber 58 of the fuel reservoir 15*a*, the inner chamber 58 extending into the connector neck 64. The cylindrical inner chamber 58, on its end, merges in stepped fashion with the inlet bore 56 of the pressure limiting valve 49*a*. The connector neck 64 serves only to sealingly secure the valve housing 51, which to that end, with a portion (a) of its length, fits over and surrounds the connector neck 64. The (remaining) portion of the valve housing 51 that does not fit over the connector neck 64 remains, for receiving the valve spring 52 and the platelike spring support 53.

The valve spring 52 is embodied as a compression spring; on the front end it is operatively connected to the spring support 53, and on the back end it is braced on a bottom 65 of the valve housing 51. Via the spring support 53, the valve spring 52 exerts a force, determined by its spring constant and its prestressing, on the ball-shaped valve body 54 in the closing direction (arrow 66) of the pressure limiting valve 49. The closing force exerted by the valve spring 52 acts on the valve body 54 counter to an opening pressure (arrow 67) determined by the pressure inside the fuel reservoir 15 (the so-called rail pressure). If the opening force effected by the rail pressure exceeds the closing force of the valve spring 52, then the valve body 54 moves in the direction of the arrow 67, and the pressure limiting valve 49*a* opens. A certain (comparatively slight) fuel quantity then flows out of the inner chamber 58 of the fuel reservoir 15*a* into the valve housing 51, and from there it flows back into the fuel tank (10, FIG. 1) via the return connector 57 and the return line (50 in FIG. 1). This process lasts until such time as the rail pressure in the inner chamber 58 of the fuel reservoir 15*a* has dropped back below its maximum value again.

To assure the pressure-limiting process described above, a good fixation and sealing of the valve housing 51 on the fuel reservoir 15*a* is necessary. The fixation, in the exemplary embodiment shown in FIG. 2, is effected at 68 in a simple way, for instance by shearing, crimping, welding, and so forth. By a suitable choice or variation of the slip-on measurement a of the pressure limiting valve housing 51 relative to the connector neck 64, and the thus-determined prestressing of the valve spring 52, it is possible to set or—if needed—adjust the opening pressure of the pressure limiting valve 49*a* without major effort.

The sealing off of the pressure limiting valve housing 51 from the fuel reservoir 15*a* is effected at 69; the special feature here is that this is a low-pressure seal. This substantial advantage (compared to the high-pressure sealing of pressure limiting valves in the prior art) is made possible by the (partial) integration, shown here and described above, of the pressure limiting valve 49*a* with the fuel reservoir 15*a*. With respect to the sealing provisions for the low-pressure sealing in detail, simple O-ring seals can for instance be used—as shown in FIG. 2 (see reference numeral 69).

Figure 3:
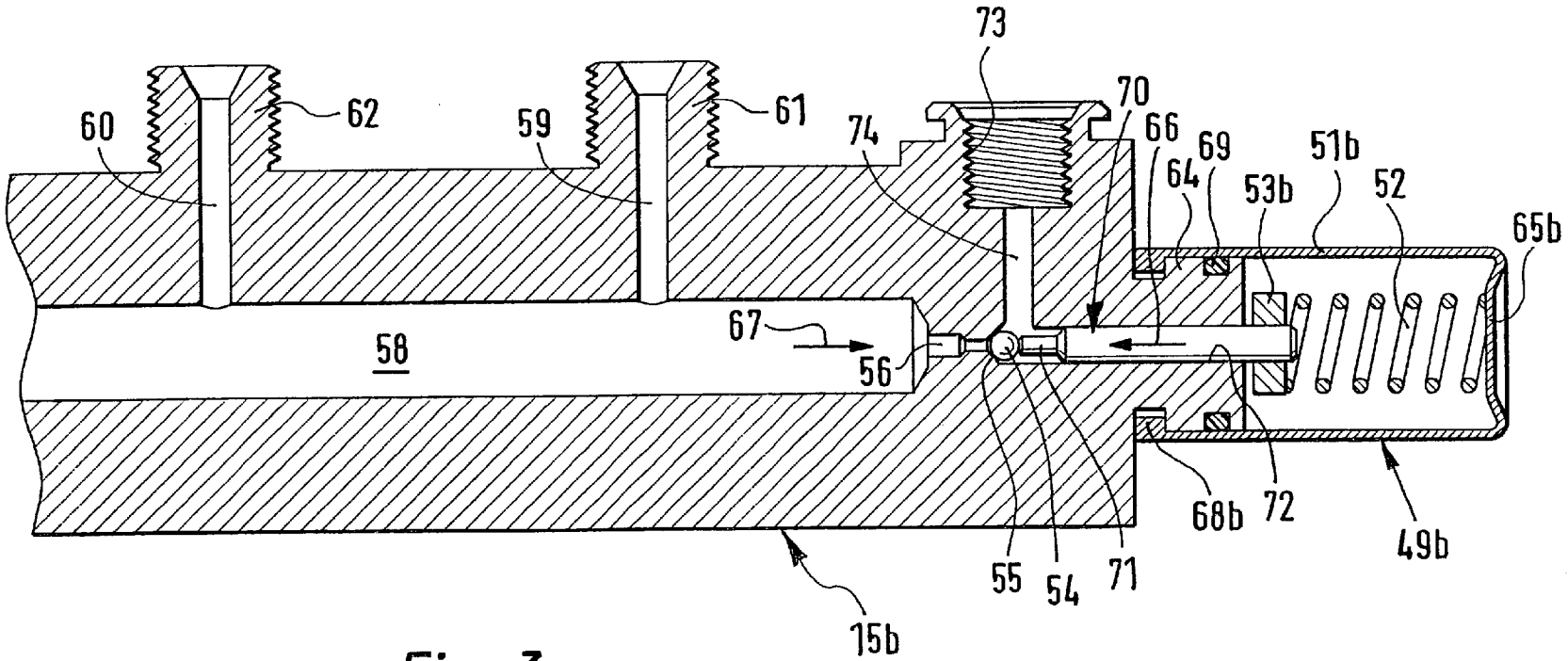
FIG. 3 shows another embodiment of a pressure limiting valve, in a view corresponding to FIG. 2.

The fundamental principle of a (partial) integration of the pressure limiting valve with the fuel reservoir and the advantages thus obtained, especially in terms of shifting the sealing out of the high-pressure region to the low-pressure region of the valve, are also achieved in the embodiment of FIG. 3. There are differences, however, structurally. In FIG. 3, the pressure limiting valve is identified overall by reference numeral 49*b* and the fuel reservoir is identified overall by reference numeral 15*b*. Otherwise, elements of the fuel reservoir 15*b* that correspond to those of the embodiment of FIG. 2 are identified by the same reference numerals as in FIG. 2. For instance, the fuel reservoir 15*b*—similarly to the embodiment of FIG. 2—has a connector neck 64, onto which the housing 51*b* of the pressure limiting valve 49*b* is slipped, secured (at 68*b*, for instance by shear crimping), and sealed off (at 69, for instance by an O-ring seal). A structural difference from FIG. 2 is that in the variant of FIG. 3, the valve seat 55 and valve body 54 are shifted farther into the interior of the fuel reservoir 15*b*. To enable actuation of the valve body 54 in the valve closing direction 66 by means of the valve spring 52 via a spring support 53*b*, the spring support 53*b* is solidly connected to a rodlike actuating element 70, which ends in an extension 71 of narrowed diameter that cooperates with the valve body 54. The actuating element 70 is supported, in a manner capable of reciprocation, in a guide bore 72 of the fuel reservoir 15*b* and of its connector neck 64.

Since in the variant of FIG. 3, unlike the embodiment of FIG. 2, the valve seat 55 and valve body 54 are not disposed in the connector neck 64 but instead are shifted into the interior of the fuel reservoir 15*b*, and since—because of the actuating element 70 disposed sealingly in the guide bore 72—there is no hydraulic communication with inner chamber of the pressure limiting valve housing 51*b*, a return connector 73 is provided not on the pressure limiting valve housing 51*b* but instead on the fuel reservoir 15*b*. In this case—again inside the fuel reservoir 15*b*—a return line 74 is provided on the low-pressure side of the valve seat 55, laterally adjoining the bore 72 that contains the actuating element 70; this return bore 74 discharges into a return connector 73 on the outer circumference of the fuel reservoir 15*b*.

Another special feature of the variant of FIG. 3 is that the pressure limiting valve housing 51*b* has a plastically deformable bottom 65*b*, on which—as in the embodiment of FIG. 2 as well—the valve spring 52 is braced. By plastic deformation of the housing bottom 65*b* in the axial direction 66 or 67, the prestressing of the valve spring 52 and thus the opening pressure of the pressure limiting valve 49 can thus be set or adjusted. (A corresponding plastic deformability for the sake of settability or adjustability of the spring prestressing and thus of the valve opening pressure can naturally be provided in the case of the valve housing bottom 65 of FIG. 2 as well. However, the return connector 57 should not be impaired thereby.).

The foregoing relates to preferred exemplary embodiments of the invention, it being understood that other variants and embodiments thereof are possible within the spirit and scope of the invention, the latter being defined by the appended claims.

We claim:

1. A fuel injection system for internal combustion engines, in particular Diesel engines, comprising a fuel reservoir (15, 15*a*, 15*b*), a high-pressure pump (14) which supplies fuel to the fuel reservoir, a number of injectors (22–25) corresponding to the number of cylinders of the engine, the injectors being supplied with fuel from the fuel reservoir, and a pressure limiting valve (49, 49*a*, 49*b*), which is connected sealingly to the fuel reservoir and which has a valve housing (51, 51*b*), a high-pressure region (inlet 56), a low-pressure region (return 57; 73, 74), a valve seat (55) oriented toward the inlet, an axially displaceable valve body (54), and a valve spring (52) urging the valve body in the direction of the valve seat, the pressure limiting valve (49, 49*a*, 49*b*) being integrated—at least partially—with the fuel reservoir (15, 15*a*, 15*b*), in such a way that at least the valve seat (55) and the valve body (54) are spatially associated with the fuel reservoir (15, 15*a*, 15*b*), and the seal (69) sealing off the pressure limiting valve (49, 49*a*, 49*b*) from the fuel reservoir (15, 15*a*, 15*b*) is associated with the low-pressure region of the pressure limiting valve (49, 49*a*, 49*b*).

2. The fuel injection system of claim 1, wherein the fuel reservoir (15*a*, 15*b*) has a cylindrical inner chamber (58), which communicates on one end with the high-pressure pump (14) via a pressure line (17) and on its other end forms the inlet (56) for the pressure limiting valve (49*a*, 49*b*), further comprising a connector neck (64) on the valve end of the fuel reservoir (15*a*, 15*b*), for the housing (51, 51*b*) of the pressure limiting valve (49*a*, 49*b*), which connector neck is concentric with the inner chamber (58) of the fuel reservoir and with the inlet (56) of the pressure limiting valve (49*a*, 49*b*), the housing (51, 51*b*) of the pressure limiting valve, with a portion (a) of its length surrounding the connector neck (64) and being sealed off from it by a low-pressure seal (69).

3. The fuel injection system of claim 2, wherein the remaining portion of the pressure limiting valve housing (51, 51*b*) that does not surround the connector neck (64) of the fuel reservoir (15*a*, 15*b*) contains the valve spring (52), embodied as a compression spring; and wherein the valve spring (52), supported at the back on a bottom (65, 65*b*) of the pressure limiting valve housing (51, 51*b*) is operatively connected, on its other end, toward the valve, via a spring support (53, 53*b*) to the valve body (54)—pressing it into the valve seat (55) counter to the pressure prevailing in the inner chamber (58) of the fuel reservoir (15*a*, 15*b*).

4. The fuel injection system of claim 1, wherein the pressure limiting valve inlet is an inlet bore (56), coaxially adjoining the cylindrically inner chamber (58) of the fuel reservoir (15*a*, 15*b*), but having a reduced diameter compared to the fuel reservoir, which inlet bore, on its end toward the valve, forms the valve seat (55) of the pressure limiting valve (49*a*, 49*b*).

5. The fuel injection system of claim 2, wherein the pressure limiting valve inlet is an inlet bore (56), coaxially adjoining the cylindrically inner chamber (58) of the fuel reservoir (15*a*, 15*b*), but having a reduced diameter compared to the fuel reservoir, which inlet bore, on its end toward the valve, forms the valve seat (55) of the pressure limiting valve (49*a*, 49*b*).

6. The fuel injection system of claim 3, wherein the pressure limiting valve inlet is an inlet bore (56), coaxially adjoining the cylindrically inner chamber (58) of the fuel reservoir (15*a*, 15*b*), but having a reduced diameter compared to the fuel reservoir, which inlet bore, on its end toward the valve, forms the valve seat (55) of the pressure limiting valve (49*a*, 49*b*).

7. The fuel injection system of claim 3, wherein the connector neck (64) contains the inlet bore (56), and the valve seat (55) is embodied on the face end of the connector neck (64).

8. The fuel injection system of claim 4, wherein the connector neck (64) contains the inlet bore (56), and the valve seat (55) is embodied on the face end of the connector neck (64).

9. The fuel injection system of claim 3, wherein the valve spring (52) acts on a platelike spring support (53), which is operatively connected directly to the valve body (54).

10. The fuel injection system of claim 4, wherein the valve spring (52) acts on a platelike spring support (53), which is operatively connected directly to the valve body (54).

11. The fuel injection system of claim 7, wherein the valve spring (52) acts on a platelike spring support (53), which is operatively connected directly to the valve body (54).

12. The fuel injection system of claim 4, wherein a connector (57) for the return (on the low-pressure side) is embodied on the end, remote from the fuel reservoir (15*a*), of the pressure limiting valve housing (51), beginning at its bottom (65).

13. The fuel injection system of claim 7, wherein a connector (57) for the return (on the low-pressure side) is embodied on the end, remote from the fuel reservoir (15*a*), of the pressure limiting valve housing (51), beginning at its bottom (65).

14. The fuel injection system of claim 9, wherein a connector (57) for the return (on the low-pressure side) is embodied on the end, remote from the fuel reservoir (15*a*), of the pressure limiting valve housing (51), beginning at its bottom (65).

15. The fuel injection system of claim 3, wherein the pressure limiting valve inlet is an inlet bore (56), coaxially adjoining the cylindrically inner chamber (58) of the fuel reservoir (15*a*, 15*b*), but having a reduced diameter compared to the fuel reservoir, which inlet bore, on its end toward the valve, forms the valve seat (55) of the pressure limiting valve (49*a*, 49*b*), and wherein the inlet bore (56) and valve seat (55) are disposed inside the fuel reservoir (15*b*); and that the connector neck (64) has a bore (72) which is coaxial to the inlet bore (56) and in which a cylindrical actuating element (70), operatively connected to the valve body (64), is disposed such that it can reciprocate, and which on its end (53*b*) protruding out of the connector neck (64) and into the pressure limiting valve housing (51*b*), is acted upon by the valve spring (52).

16. The fuel injection system of claim 15, wherein inside the fuel reservoir (15*b*), on the low-pressure side of the valve seat (55), laterally adjoining the bore (72) containing the actuating element (70), a return bore (74) is provided, which discharges at the outer circumference of the fuel reservoir (15*b*) into a return connector (73) (FIG. 3).

17. The fuel injection system of claim 1, wherein the valve body (54) of the pressure limiting valve (49*a*, 49*b*) is embodied as a ball.

18. The fuel injection system of claim 2, wherein the housing (51, 51*b*) of the pressure limiting valve (49*a*, 49*b*) is connected to the connector neck (64) by shear crimping (68, 68*b*).

19. The fuel injection system of claim 1, wherein the housing (51, 51*b*) of the pressure limiting valve (49*a*, 49*b*) is sealed off on the low-pressure side by an O-ring seal (69) from the connector neck (64) and thus from the fuel reservoir (15*a*, 15*b*).

20. The fuel injection system of claim 2, wherein the prestressing of the valve spring (52) and thus the opening pressure of the pressure limiting valve (49*a*, 49*b*) is settable or adjustable by means of the slip-on measurement (a) of the pressure limiting valve housing (51, 51*b*).

21. The fuel injection system of claim 2, wherein that the prestressing of the valve spring (52) and thus the opening pressure of the pressure limiting valve (49*a*, 49*b*) is settable or adjustable by means of the bottom (65, 65*b*) of the pressure limiting valve housing (51, 51*b*), which bottom is deformable for this purpose.

* * * * *